US007267749B2

(12) United States Patent
Wilson et al.

(10) Patent No.: US 7,267,749 B2
(45) **Date of Patent: *Sep. 11, 2007**

(54) WORKPIECE PROCESSOR HAVING PROCESSING CHAMBER WITH IMPROVED PROCESSING FLUID FLOW

(75) Inventors: Gregory J. Wilson, Kalispell, MT (US); Paul R. McHugh, Kalispell, MT (US); Kyle M. Hanson, Kalispell, MT (US)

(73) Assignee: Semitool, Inc., Kalispell, MT (US)

( * ) Notice: Subject to any disclaimer, the term of this patent is extended or adjusted under 35 U.S.C. 154(b) by 4 days.

This patent is subject to a terminal disclaimer.

(21) Appl. No.: 10/400,186

(22) Filed: Mar. 26, 2003

(65) Prior Publication Data

US 2004/0055877 A1 Mar. 25, 2004

Related U.S. Application Data

(63) Continuation of application No. 09/804,696, filed on Mar. 12, 2001, now Pat. No. 6,569,297, which is a continuation of application No. PCT/US00/10210, filed on Apr. 13, 2000.

(60) Provisional application No. 60/182,160, filed on Feb. 14, 2000, provisional application No. 60/143,769, filed on Jul. 12, 1999, provisional application No. 60/128,055, filed on Apr. 13, 1999.

(51) Int. Cl.

| | |
|---|---|
| ***C25D 5/08*** | (2006.01) |
| ***C25D 17/06*** | (2006.01) |
| ***C25B 9/12*** | (2006.01) |
| *C25D 3/38* | (2006.01) |

(52) U.S. Cl. ..... 204/273; 204/212; 204/242; 204/260; 204/263; 204/275.1; 204/287; 205/123; 205/291

(58) Field of Classification Search ..... 204/212, 204/224 R, 224 M, 225, 275.1, 471, 479, 204/512, 242, 260, 263, 273, 287; 134/902, 134/220, 198; 257/E21; 205/123, 291
See application file for complete search history.

(56) References Cited

U.S. PATENT DOCUMENTS 1,526,644 A 2/1925 Pinney
(Continued)

FOREIGN PATENT DOCUMENTS

CA 873651 6/1971
(Continued)

OTHER PUBLICATIONS

Patent Abstract of Japan, "Organic Compound and its Application," Publciation No. 08-003153, Publication Date: Jan. 9, 1996.
(Continued)

*Primary Examiner*—Roy King
*Assistant Examiner*—Lois Zheng
(74) *Attorney, Agent, or Firm*—Perkins Coie LLP

(57) ABSTRACT

A processing container (610) for providing a flow of a processing fluid during immersion processing of at least one surface of a microelectronic workpiece is set forth. The processing container comprises a principal fluid flow chamber (505) providing a flow of processing fluid to at least one surface of the workpiece and a plurality of nozzles (535) disposed to provide a flow of processing fluid to the principal fluid flow chamber. The plurality of nozzles are arranged and directed to provide vertical and radial fluid flow components that combine to generate a substantially uniform normal flow component radially across the surface of the workpiece. An exemplary apparatus using such a processing container is also set forth that is particularly adapted to carry out an electroplating process. In accordance with a further aspect of the present disclosure, an improved fluid removal path (640) is provided for removing fluid from a principal fluid flow chamber during immersion processing of a microelectronic workpiece.

32 Claims, 8 Drawing Sheets

U.S. PATENT DOCUMENTS

| | | | | |
|---|---|---|---|---|
| 1,881,713 | A | | 10/1932 | Laukel |
| 2,256,274 | A | | 9/1941 | Boedecker et al. |
| 3,309,263 | A | | 3/1967 | Grobe |
| 3,616,284 | A | | 10/1971 | Bodmer et al. |
| 3,664,933 | A | | 5/1972 | Clauss |
| 3,706,635 | A | | 12/1972 | Kowalski |
| 3,706,651 | A | | 12/1972 | Leland |
| 3,716,462 | A | | 2/1973 | Jensen |
| 3,727,620 | A | | 4/1973 | Orr |
| 3,798,003 | A | | 3/1974 | Ensley et al. |
| 3,798,033 | A | | 3/1974 | Yost, Jr. |
| 3,878,066 | A | | 4/1975 | Dettke et al. |
| 3,930,963 | A | | 1/1976 | Polichette et al. |
| 3,953,265 | A | | 4/1976 | Hood |
| 3,968,885 | A | | 7/1976 | Hassan et al. |
| 4,000,046 | A | | 12/1976 | Weaver |
| 4,022,679 | A | | 5/1977 | Koziol et al. |
| 4,030,015 | A | | 6/1977 | Herko et al. |
| 4,046,105 | A | | 9/1977 | Gomez |
| 4,072,557 | A | | 2/1978 | Schiel |
| 4,082,638 | A | | 4/1978 | Jumer |
| 4,113,577 | A | | 9/1978 | Ross et al. |
| 4,132,567 | A | | 1/1979 | Blackwood |
| 4,134,802 | A | | 1/1979 | Herr |
| 4,137,867 | A | | 2/1979 | Aigo |
| 4,165,252 | A | | 8/1979 | Gibbs |
| 4,170,959 | A | | 10/1979 | Aigo |
| 4,222,834 | A | | 9/1980 | Bacon et al. |
| 4,238,310 | A | | 12/1980 | Eckler et al. |
| 4,246,088 | A | | 1/1981 | Murphy et al. |
| 4,259,166 | A | | 3/1981 | Whitehurst |
| 4,276,855 | A | | 7/1981 | Seddon |
| 4,286,541 | A | | 9/1981 | Blackwood |
| 4,287,029 | A | | 9/1981 | Shimamura |
| 4,304,641 | A | | 12/1981 | Grandia et al. |
| 4,323,433 | A | | 4/1982 | Loch |
| 4,341,629 | A | | 7/1982 | Uhlinger |
| 4,360,410 | A | | 11/1982 | Fletcher et al. |
| 4,378,283 | A | | 3/1983 | Seyffert |
| 4,384,930 | A | | 5/1983 | Eckles |
| 4,391,694 | A | | 7/1983 | Runsten |
| 4,422,915 | A | | 12/1983 | Wielonski et al. |
| 4,431,361 | A | | 2/1984 | Bayne |
| 4,437,943 | A | | 3/1984 | Beck et al. |
| 4,439,243 | A | | 3/1984 | Titus |
| 4,439,244 | A | | 3/1984 | Allevato |
| 4,440,597 | A | | 4/1984 | Wells et al. |
| 4,443,117 | A | | 4/1984 | Muramoto et al. |
| 4,449,885 | A | | 5/1984 | Hertel et al. |
| 4,451,197 | A | | 5/1984 | Lange |
| 4,463,503 | A | | 8/1984 | Applegate |
| 4,466,864 | A | | 8/1984 | Bacon |
| 4,469,566 | A | | 9/1984 | Wray |
| 4,475,823 | A | | 10/1984 | Stone |
| 4,480,028 | A | | 10/1984 | Kato et al. |
| 4,495,153 | A | | 1/1985 | Midorikawa |
| 4,495,453 | A | | 1/1985 | Inaba |
| 4,500,394 | A | | 2/1985 | Rizzo |
| 4,529,480 | A | | 7/1985 | Trokhan |
| 4,541,895 | A | | 9/1985 | Albert |
| 4,544,446 | A | | 10/1985 | Cady |
| 4,566,847 | A | | 1/1986 | Maeda |
| 4,576,685 | A | | 3/1986 | Goffredo et al. |
| 4,576,689 | A | | 3/1986 | Makkaev et al. |
| 4,585,539 | A | | 4/1986 | Edson |
| 4,604,177 | A | | 8/1986 | Sivilotti |
| 4,604,178 | A | | 8/1986 | Fiegener |
| 4,634,503 | A | | 1/1987 | Nogavich |
| 4,639,028 | A | | 1/1987 | Olson |
| 4,648,944 | A | | 3/1987 | George et al. |
| 4,664,133 | A | | 5/1987 | Silvernail |
| 4,670,126 | A | | 6/1987 | Messer et al. |
| 4,685,414 | A | | 8/1987 | DiRico |
| 4,687,552 | A | | 8/1987 | Early et al. |
| 4,693,017 | A | | 9/1987 | Oehler et al. |
| 4,696,729 | A | | 9/1987 | Santini |
| 4,715,934 | A | | 12/1987 | Tamminen |
| 4,732,785 | A | | 3/1988 | Brewer |
| 4,741,624 | A | | 5/1988 | Barroyer |
| 4,750,505 | A | | 6/1988 | Inuta |
| 4,760,671 | A | | 8/1988 | Ward |
| 4,761,214 | A | | 8/1988 | Hinman |
| 4,770,590 | A | | 9/1988 | Hugues et al. |
| 4,773,436 | A | * | 9/1988 | Cantrell et al. ..... 134/108 |
| 4,781,800 | A | | 11/1988 | Goldman et al. |
| 4,790,262 | A | | 12/1988 | Nakayama |
| 4,800,818 | A | | 1/1989 | Kawaguchi et al. |
| 4,824,538 | A | * | 4/1989 | Hibino et al. ..... 204/472 |
| 4,828,654 | A | | 5/1989 | Reed |
| 4,838,289 | A | | 6/1989 | Kottman |
| 4,849,054 | A | | 7/1989 | Klowak |
| 4,858,539 | A | | 8/1989 | Schumann |
| 4,864,239 | A | | 9/1989 | Casarcia et al. |
| 4,868,992 | A | | 9/1989 | Crafts et al. |
| 4,898,647 | A | | 2/1990 | Luce et al. |
| 4,902,398 | A | | 2/1990 | Homstad |
| 4,903,717 | A | | 2/1990 | Sumnitsch |
| 4,906,341 | A | | 3/1990 | Yamakawa |
| 4,911,818 | A | * | 3/1990 | Kikuchi et al. ..... 204/479 |
| 4,913,085 | A | | 4/1990 | Vohringer et al. |
| 4,924,890 | A | | 5/1990 | Giles et al. |
| 4,944,650 | A | | 7/1990 | Matsumoto |
| 4,949,671 | A | | 8/1990 | Davis et al. |
| 4,951,601 | A | | 8/1990 | Maydan et al. |
| 4,959,278 | A | | 9/1990 | Shimauchi et al. |
| 4,962,726 | A | | 10/1990 | Matsushita et al. |
| 4,979,464 | A | | 12/1990 | Kunze-Concewitz et al. |
| 4,982,215 | A | | 1/1991 | Matsuoka |
| 4,982,753 | A | | 1/1991 | Grebinski |
| 4,988,533 | A | | 1/1991 | Freeman et al. |
| 5,000,827 | A | | 3/1991 | Schuster et al. |
| 5,020,200 | A | | 6/1991 | Mimasaka |
| 5,024,746 | A | | 6/1991 | Stierman et al. |
| 5,026,239 | A | | 6/1991 | Chiba |
| 5,032,217 | A | | 7/1991 | Tanaka |
| 5,048,589 | A | | 9/1991 | Cook et al. |
| 5,054,988 | A | | 10/1991 | Shiraiwa |
| 5,055,036 | A | | 10/1991 | Asano et al. |
| 5,061,144 | A | | 10/1991 | Akimoto |
| 5,069,548 | A | | 12/1991 | Boehnlein |
| 5,078,852 | A | | 1/1992 | Yee |
| 5,083,364 | A | | 1/1992 | Olbrich et al. |
| 5,096,550 | A | | 3/1992 | Mayer et al. |
| 5,110,248 | A | | 5/1992 | Asano et al. |
| 5,115,430 | A | | 5/1992 | Hahne et al. |
| 5,117,769 | A | | 6/1992 | DeBoer |
| 5,125,784 | A | | 6/1992 | Asano |
| 5,128,912 | A | | 7/1992 | Hug et al. |
| 5,135,636 | A | | 8/1992 | Yee et al. |
| 5,138,973 | A | | 8/1992 | Davis et al. |
| 5,146,136 | A | | 9/1992 | Ogura |
| 5,151,168 | A | | 9/1992 | Gilton et al. |
| 5,155,336 | A | | 10/1992 | Gronet et al. |
| 5,156,174 | A | | 10/1992 | Thompson |
| 5,156,730 | A | | 10/1992 | Bhatt et al. |
| 5,168,886 | A | | 12/1992 | Thompson et al. |
| 5,168,887 | A | | 12/1992 | Thompson |
| 5,169,408 | A | | 12/1992 | Biggerstaff et al. |
| 5,172,803 | A | | 12/1992 | Lewin |
| 5,174,045 | A | | 12/1992 | Thompson et al. |
| 5,178,512 | A | | 1/1993 | Skrobak |
| 5,178,639 | A | | 1/1993 | Nishi |
| 5,180,273 | A | | 1/1993 | Salaya et al. |
| 5,183,377 | A | | 2/1993 | Becker et al. |

5,186,594 A 2/1993 Toshima et al.
5,209,180 A 5/1993 Shoda
5,209,817 A 5/1993 Ahmad et al.
5,217,586 A 6/1993 Datta et al.
5,222,310 A 6/1993 Thompson et al.
5,224,503 A 7/1993 Thompson
5,224,504 A 7/1993 Thompson et al.
5,227,041 A 7/1993 Brogden et al.
5,228,232 A 7/1993 Miles
5,228,966 A 7/1993 Murata
5,230,371 A 7/1993 Lee
5,232,511 A 8/1993 Bergman
5,235,995 A 8/1993 Bergman et al.
5,238,500 A 8/1993 Bergman
5,252,137 A 10/1993 Tateyama et al.
5,252,807 A 10/1993 Chizinsky
5,256,262 A 10/1993 Blomsterberg
5,256,274 A 10/1993 Poris
5,271,953 A 12/1993 Litteral
5,271,972 A 12/1993 Kwok et al.
5,301,700 A 4/1994 Kamikawa et al.
5,302,464 A 4/1994 Nomura et al.
5,306,895 A 4/1994 Ushikoshi et al.
5,314,294 A 5/1994 Taniguchi
5,316,642 A 5/1994 Young
5,326,455 A 7/1994 Kubo et al.
5,330,604 A 7/1994 Allum et al.
5,332,271 A 7/1994 Grant et al.
5,332,445 A 7/1994 Bergman
5,340,456 A 8/1994 Mehler
5,344,491 A 9/1994 Katou
5,348,620 A 9/1994 Hermans et al.
5,349,978 A 9/1994 Sago
5,361,449 A 11/1994 Akimoto
5,363,171 A 11/1994 Mack
5,364,504 A 11/1994 Smurkoski et al.
5,366,785 A 11/1994 Sawdai
5,366,786 A 11/1994 Connor et al.
5,368,711 A 11/1994 Poris
5,372,848 A 12/1994 Blackwell et al.
5,376,176 A 12/1994 Kuriyama
5,377,708 A 1/1995 Bergman
5,388,945 A 2/1995 Garric et al.
5,391,285 A 2/1995 Lytle et al.
5,391,517 A 2/1995 Gelatos et al.
5,393,624 A 2/1995 Ushijima
5,405,518 A 4/1995 Hsieh et al.
5,411,076 A 5/1995 Matsunaga et al.
5,421,893 A 6/1995 Perlov
5,421,987 A 6/1995 Tzanavaras et al.
5,427,674 A 6/1995 Langenskiold et al.
5,429,686 A 7/1995 Chiu et al.
5,429,733 A 7/1995 Ishida
5,431,421 A 7/1995 Thompson
5,431,803 A 7/1995 DiFranco et al.
5,437,777 A 8/1995 Kishi
5,441,629 A 8/1995 Kosaki
5,442,416 A 8/1995 Tateyama et al.
5,443,707 A 8/1995 Mori
5,445,484 A 8/1995 Kato et al.
5,447,615 A 9/1995 Ishida
5,454,405 A 10/1995 Hawes
5,460,478 A 10/1995 Akimoto et al.
5,464,313 A 11/1995 Ohsawa
5,472,502 A 12/1995 Batchelder
5,474,807 A 12/1995 Koshiishi
5,489,341 A 2/1996 Bergman et al.
5,500,081 A 3/1996 Bergman
5,501,768 A 3/1996 Hermans et al.
5,508,095 A 4/1996 Allum et al.
5,510,645 A 4/1996 Fitch
5,512,319 A 4/1996 Cook et al.
5,513,594 A 5/1996 McClanahan
5,514,258 A 5/1996 Brinket et al.
5,516,412 A 5/1996 Andricacos et al.
5,522,975 A 6/1996 Andricacos et al.
5,527,390 A 6/1996 Ono et al.
5,544,421 A 8/1996 Thompson et al.
5,549,808 A 8/1996 Farooq et al.
5,551,986 A 9/1996 Jain
5,567,267 A 10/1996 Kazama et al.
5,571,325 A 11/1996 Ueyama
5,575,611 A 11/1996 Thompson et al.
5,584,310 A 12/1996 Bergman
5,584,971 A 12/1996 Komino
5,591,262 A 1/1997 Sago
5,593,545 A 1/1997 Rugowski et al.
5,597,460 A 1/1997 Reynolds
5,597,836 A 1/1997 Hackler et al.
5,600,532 A 2/1997 Michiya et al.
5,609,239 A 3/1997 Schlecker
5,616,069 A 4/1997 Walker
5,620,581 A 4/1997 Ang
5,639,206 A 6/1997 Oda et al.
5,639,316 A 6/1997 Cabral, Jr. et al.
5,641,613 A 6/1997 Boff et al.
5,650,082 A 7/1997 Anderson
5,651,823 A 7/1997 Parodi et al.
5,651,836 A * 7/1997 Suzuki ..... 134/34
5,658,183 A 8/1997 Sandhu
5,658,387 A 8/1997 Reardon
5,660,472 A 8/1997 Peuse et al.
5,660,517 A 8/1997 Thompson et al.
5,662,788 A 9/1997 Sandhu
5,664,337 A 9/1997 Davis et al.
5,666,985 A 9/1997 Smith
5,670,034 A 9/1997 Lowery
5,676,337 A 10/1997 Giras et al.
5,677,118 A 10/1997 Spara et al.
5,677,824 A 10/1997 Harashima
5,678,116 A 10/1997 Sugimoto
5,678,320 A 10/1997 Thompson et al.
5,681,392 A 10/1997 Swain
5,683,564 A 11/1997 Reynolds
5,684,654 A 11/1997 Searle et al.
5,684,713 A 11/1997 Asada et al.
5,700,127 A 12/1997 Harada
5,700,180 A 12/1997 Sandhu
5,711,646 A 1/1998 Ueda et al.
5,718,763 A 2/1998 Tateyama
5,719,495 A 2/1998 Moslehi
5,723,028 A 3/1998 Poris
5,731,678 A 3/1998 Zila et al.
5,744,019 A 4/1998 Ang
5,746,565 A 5/1998 Tepolt
5,747,098 A 5/1998 Larson
5,754,842 A 5/1998 Minagawa
5,755,948 A 5/1998 Lazaro et al.
5,759,006 A 6/1998 Miyamoto et al.
5,762,708 A 6/1998 Motoda
5,762,751 A 6/1998 Bleck
5,765,444 A 6/1998 Bacchi
5,765,889 A 6/1998 Nam et al.
5,776,327 A 7/1998 Botts et al.
5,779,796 A 7/1998 Tomoeda
5,785,826 A 7/1998 Greenspan
5,788,829 A 8/1998 Joshi et al.
5,802,856 A 9/1998 Schaper et al.
5,815,762 A 9/1998 Sakai
5,829,791 A 11/1998 Kotsubo et al.
5,843,296 A 12/1998 Greenspan
5,845,662 A 12/1998 Sumnitsch
5,860,640 A 1/1999 Marohl
5,868,866 A 2/1999 Maekawa
5,871,626 A 2/1999 Crafts et al.
5,871,805 A 2/1999 Lemelson 5,872,633 A 2/1999 Holzapfel
5,882,433 A 3/1999 Ueno
5,882,498 A 3/1999 Dubin et al.
5,885,755 A 3/1999 Nakagawa
5,892,207 A 4/1999 Kawamura et al.
5,900,663 A 5/1999 Johnson
5,904,827 A 5/1999 Reynolds
5,908,543 A 6/1999 Matsunami et al.
5,916,366 A 6/1999 Ueyama
5,924,058 A 7/1999 Waldhauer
5,925,227 A 7/1999 Kobayashi et al.
5,932,077 A 8/1999 Reynolds
5,937,142 A 8/1999 Moslehi et al.
5,942,035 A 8/1999 Hasebe
5,948,203 A 9/1999 Wang
5,952,050 A 9/1999 Doan
5,957,836 A 9/1999 Johnson
5,964,643 A 10/1999 Birang
5,980,706 A 11/1999 Bleck
5,985,126 A 11/1999 Bleck
5,989,397 A 11/1999 Laube et al.
5,989,406 A 11/1999 Beetz, Jr. et al.
5,997,653 A 12/1999 Yamasaka
5,998,123 A 12/1999 Tanaka et al.
5,999,886 A 12/1999 Martin et al.
6,001,235 A 12/1999 Arken et al.
6,004,047 A 12/1999 Akimoto
6,004,828 A 12/1999 Hanson
6,017,437 A 1/2000 Ting
6,017,820 A 1/2000 Ting et al.
6,025,600 A 2/2000 Archie
6,027,631 A 2/2000 Broadbent
6,028,986 A 2/2000 Song
6,045,618 A 4/2000 Raoux
6,051,284 A 4/2000 Byrne et al.
6,053,687 A 4/2000 Kirkpatrick
6,063,190 A 5/2000 Hasebe et al.
6,072,160 A 6/2000 Bahl
6,072,163 A 6/2000 Armstrong et al.
6,074,544 A 6/2000 Reid et al.
6,077,412 A 6/2000 Ting
6,080,288 A 6/2000 Schwartz et al.
6,080,291 A 6/2000 Woodruff et al.
6,080,691 A 6/2000 Lindsay et al.
6,086,680 A 7/2000 Foster et al.
6,090,260 A 7/2000 Inoue et al.
6,091,498 A 7/2000 Hanson
6,099,702 A 8/2000 Reid
6,099,712 A 8/2000 Ritzdorf
6,103,085 A 8/2000 Woo et al.
6,107,192 A 8/2000 Subrahmanyan et al.
6,108,937 A 8/2000 Raaijmakers
6,110,011 A 8/2000 Somekh
6,110,346 A 8/2000 Reid et al.
6,122,046 A 9/2000 Almogy
6,130,415 A 10/2000 Knoot
6,132,289 A 10/2000 Labunsky
6,132,587 A * 10/2000 Jorne et al. ..... 205/123
6,136,163 A 10/2000 Cheung
6,139,703 A 10/2000 Hanson et al.
6,139,708 A * 10/2000 Nonomura et al. ..... 204/482
6,139,712 A 10/2000 Patton
6,140,234 A 10/2000 Uzoh et al.
6,143,147 A 11/2000 Jelinek
6,143,155 A 11/2000 Adams
6,149,729 A 11/2000 Iwata
6,151,532 A 11/2000 Barone et al.
6,156,167 A 12/2000 Patton et al.
6,157,106 A 12/2000 Tietz et al.
6,159,073 A 12/2000 Wiswesser
6,159,354 A 12/2000 Contolini et al.
6,162,344 A 12/2000 Reid et al.
6,162,488 A 12/2000 Gevelber et al.
6,168,693 B1 1/2001 Uzoh
6,168,695 B1 1/2001 Woodruff
6,174,425 B1 1/2001 Simpson
6,174,796 B1 1/2001 Takagi et al.
6,179,983 B1 1/2001 Reid et al.
6,184,068 B1 2/2001 Ohtani et al.
6,187,072 B1 2/2001 Cheung
6,190,234 B1 2/2001 Swedek et al.
6,193,802 B1 2/2001 Pang
6,193,859 B1 2/2001 Contolini et al.
6,194,628 B1 2/2001 Pang
6,197,181 B1 3/2001 Chen
6,199,301 B1 3/2001 Wallace
6,201,240 B1 3/2001 Dotan
6,208,751 B1 3/2001 Almogy
6,218,097 B1 4/2001 Bell et al.
6,221,230 B1 4/2001 Takeuchi
6,228,232 B1 5/2001 Woodruff
6,231,743 B1 5/2001 Etherington
6,234,738 B1 5/2001 Kimata
6,238,539 B1 5/2001 Joyce
6,244,931 B1 6/2001 Pinson
6,247,998 B1 6/2001 Wiswesser et al.
6,251,238 B1 6/2001 Kaufman et al.
6,251,528 B1 6/2001 Uzoh et al.
6,251,692 B1 6/2001 Hanson
6,254,742 B1 7/2001 Hanson et al.
6,255,222 B1 7/2001 Xia
6,258,220 B1 7/2001 Dordi
6,261,433 B1 7/2001 Landau
6,264,752 B1 7/2001 Curtis
6,268,289 B1 7/2001 Chowdhury
6,270,619 B1 8/2001 Suzuki
6,270,634 B1 8/2001 Khan
6,270,647 B1 8/2001 Graham
6,277,194 B1 8/2001 Thilderkvist
6,277,263 B1 8/2001 Chen
6,278,089 B1 8/2001 Young et al.
6,280,183 B1 8/2001 Mayur et al.
6,280,582 B1 8/2001 Woodruff et al.
6,280,583 B1 8/2001 Woodruff et al.
6,290,865 B1 9/2001 Lloyd
6,297,154 B1 10/2001 Gross et al.
6,303,010 B1 10/2001 Woodruff et al.
6,309,520 B1 10/2001 Woodruff et al.
6,309,524 B1 10/2001 Woodruff et al.
6,309,981 B1 10/2001 Mayer
6,309,984 B1 10/2001 Nonaka
6,318,385 B1 11/2001 Curtis
6,318,951 B1 11/2001 Schmidt
6,322,112 B1 11/2001 Duncan
6,322,677 B1 11/2001 Woodruff
6,333,275 B1 12/2001 Mayer
6,342,137 B1 1/2002 Woodruff
6,350,319 B1 2/2002 Curtiss
6,365,729 B1 4/2002 Tyagi
6,391,166 B1 5/2002 Wang
6,399,505 B2 6/2002 Nogami
6,402,923 B1 6/2002 Mayer
6,409,892 B1 6/2002 Woodruff et al.
6,413,436 B1 7/2002 Aegerter
6,423,642 B1 7/2002 Peace
6,428,660 B2 8/2002 Woodruff et al.
6,428,662 B1 8/2002 Woodruff et al.
6,444,101 B1 9/2002 Stevens
6,471,913 B1 10/2002 Weaver et al.
6,481,956 B1 11/2002 Hofmeister
6,491,806 B1 12/2002 Dubin
6,494,221 B1 12/2002 Sellmer
6,497,801 B1 12/2002 Woodruff
6,562,421 B2 5/2003 Sudo
6,565,729 B2 5/2003 Chen
6,569,297 B2 * 5/2003 Wilson et al. ..... 204/212

| | | | |
|---|---|---|---|
| 6,599,412 | B1 | 7/2003 | Graham |
| 6,623,609 | B2 | 9/2003 | Harris |
| 6,632,334 | B2 | 10/2003 | Anderson |
| 6,660,137 | B2 | 12/2003 | Wilson |
| 6,678,055 | B2 | 1/2004 | Du-Nour et al. |
| 6,699,373 | B2 | 3/2004 | Woodruff |
| 6,709,562 | B1 | 3/2004 | Andricacos |
| 6,747,754 | B1 | 6/2004 | Iyoki |
| 6,755,954 | B2 | 6/2004 | Mayer et al. |
| 6,773,571 | B1 | 8/2004 | Mayer et al. |
| 2001/0024611 | A1 | 9/2001 | Woodruff |
| 2001/0032788 | A1 | 10/2001 | Woodruff |
| 2001/0043856 | A1 | 11/2001 | Woodruff |
| 2002/0008036 | A1 | 1/2002 | Wang |
| 2002/0008037 | A1 | 1/2002 | Wilson et al. |
| 2002/0022363 | A1 | 2/2002 | Ritzdorf et al. |
| 2002/0032499 | A1 | 3/2002 | Wilson |
| 2002/0046952 | A1 | 4/2002 | Graham |
| 2002/0079215 | A1 | 6/2002 | Wilson et al. |
| 2002/0096508 | A1 | 7/2002 | Weaver et al. |
| 2002/0125141 | A1* | 9/2002 | Wilson et al. ..... 205/96 |
| 2002/0139678 | A1 | 10/2002 | Wilson |
| 2003/0020928 | A1 | 1/2003 | Ritzdorf |
| 2003/0038035 | A1 | 2/2003 | Wilson |
| 2003/0062258 | A1 | 4/2003 | Woodruff |
| 2003/0066752 | A1 | 4/2003 | Ritzdorf |
| 2003/0070918 | A1 | 4/2003 | Hanson |
| 2003/0127337 | A1 | 7/2003 | Hanson |
| 2004/0031693 | A1 | 2/2004 | Chen |
| 2004/0055877 | A1 | 3/2004 | Wilson |
| 2004/0099533 | A1 | 5/2004 | Wilson |

FOREIGN PATENT DOCUMENTS

| | | | |
|---|---|---|---|
| DE | 3240330 | * | 10/1982 |
| DE | 41 14 427 | | 11/1992 |
| DE | 195 25 666 | | 10/1996 |
| EP | 0 140 404 | A1 | 8/1984 |
| EP | 0047132 | A1 | 7/1985 |
| EP | 0 677 612 | A3 | 10/1985 |
| EP | 0 257 670 | | 3/1988 |
| EP | 0 290 210 | | 11/1988 |
| EP | 0290210 | | 11/1988 |
| EP | 0 677 612 | A2 | 10/1995 |
| EP | 0582019 | B1 | 10/1995 |
| EP | 0544311 | B1 | 5/1996 |
| EP | 0 881 673 | A2 | 5/1998 |
| EP | 0 982 771 | A1 | 8/1999 |
| EP | 1 069 213 | A2 | 7/2000 |
| EP | 0452939 | B1 | 11/2000 |
| GB | 2217107 | A | 3/1989 |
| GB | 2 254 288 | A | 3/1992 |
| GB | 2 279 372 | A | 6/1994 |
| JP | 59150094 | | 8/1984 |
| JP | 1048442 | | 2/1989 |
| JP | 4144150 | | 5/1992 |
| JP | 4311591 | | 11/1992 |
| JP | 5146984 | | 6/1993 |
| JP | 5195183 | A | 8/1993 |
| JP | 5211224 | | 8/1993 |
| JP | 6017291 | A | 1/1994 |
| JP | 6073598 | A | 3/1994 |
| JP | 6224202 | A | 8/1994 |
| JP | 7113159 | A | 5/1995 |
| JP | 7197299 | A | 8/1995 |
| JP | 10-083960 | | 3/1998 |
| JP | 11036096 | A | 2/1999 |
| JP | 11080993 | A | 3/1999 |
| WO | WO-90/00476 | | 1/1990 |
| WO | WO-91/04213 | | 4/1991 |
| WO | WO-95/06326 | | 3/1995 |
| WO | WO-95/20064 | | 7/1995 |
| WO | WO99/16936 | | 4/1996 |
| WO | WO-99/16936 | | 4/1996 |
| WO | WO-99/25904 | | 5/1999 |
| WO | WO-99/25905 | | 5/1999 |
| WO | WO-99/40615 | | 8/1999 |
| WO | WO-99/41434 | | 8/1999 |
| WO | WO-99/45745 | | 9/1999 |
| WO | WO-00/02675 | | 1/2000 |
| WO | WO-00/02808 | | 1/2000 |
| WO | WO-00/02808 | A1 | 1/2000 |
| WO | WO-00/03072 | | 1/2000 |
| WO | WO-02/02808 | | 1/2000 |
| WO | WO 00/61498 | | 4/2000 |
| WO | WO 00/61837 | | 4/2000 |
| WO | WO-00/32835 | | 6/2000 |
| WO | WO-01/46910 | | 6/2001 |
| WO | WO-01/90434 | | 11/2001 |
| WO | WO-01/91163 | | 11/2001 |
| WO | WO-02/04886 | | 1/2002 |
| WO | WO-02/04887 | | 1/2002 |
| WO | WO-02/17203 | | 2/2002 |
| WO | WO-02/45476 | | 6/2002 |
| WO | WO 02/45476 | | 6/2002 |
| WO | WO-02/097165 | | 12/2002 |
| WO | WO-02/099165 | | 12/2002 |
| WO | WO-03/018874 | | 3/2003 |

OTHER PUBLICATIONS

Patent Abstract of Japan, English Abstract Translation—Japanese Utility Model No. 2538705, Publication Date: Aug. 25, 2992.

U.S. Appl. No. 08/940,524, filed Sep. 30, 1997, Bleck et al.

U.S. Appl. No. 08/990,107, filed Dec. 15, 1997, Hanson et al.

U.S. Appl. No. 09/114,105, filed Jul. 11, 1998, Woodruff et al.

U.S. Appl. No. 09/618,707, filed Jul. 18, 2000, Hanson et al.

U.S. Appl. No. 09/679,928, filed Oct. 2, 2000, Woodruff et al.

U.S. Appl. No. 10/729,349, filed Dec. 5, 2003, Klocke.

U.S. Appl. No. 10/729,357, filed Dec. 5, 2003, Klocke.

U.S. Appl. No. 10/817,659, filed Apr. 2, 2004, Wilson et al.

U.S. Appl. No. 60/129,055, McHugh.

U.S. Appl. No. 60/143,769, McHugh.

U.S. Appl. No. 60/182,160, McHugh et al.

U.S. Appl. No. 60/206,663, Wilson et al.

U.S. Appl. No. 60/294,690, Gibbons et al.

U.S. Appl. No. 60/316,597, Hanson.

U.S. Appl. No. 60/607,046, Klocke.

U.S. Appl. No. 60/607,460, Klocke.

Contolini et al., "Copper Electroplating Process for Sub-Half-Micron ULSI Structures," VMIC Conference 1995 ISMIC—04/95/0322, pp. 322-328, Jun. 17-29, 1995.

Devaraj et al., "Pulsed Electrodeposition of Copper," Plating & Surface Finishing, pp. 72-78, Aug. 1992.

Dubin, "Copper Plating Techniques for ULSI Metallization," Advanced MicroDevices.

Dubin, V.M., "Electrochemical Deposition of Copper for On-Chip Interconnects," Advanced MicroDevices.

Gauvin et al., "The Effect of Chloride Ions on Copper Deposition," J. of Electrochemical Society, vol. 99, pp. 71-75, Feb. 1952.

International Search Report for PCT/US02/17840; Applicant: Semitool, Inc., Mar. 3, 2003, 4 pgs.

International Search Report PCT/US02/17203; Semitool, Inc., Dec. 31, 2002, 4 pgs.

Lowenheim, Frederick A., "Electroplaiting," Jan. 1979, 12 pgs, McGraw-Hill Book Company, USA.

Lowenheim, Frederick A., "Electroplating Electrochemistry Applied to Electroplating," 1978, pp. 152-155, McGraw-Hill Book Company, New York.

Ossro, N.M., "An Overview of Pulse Plating," Plating and Surface Finishing, Mar. 1986.

Passal, F., "Copper Plating During the Last Fifty Years," Plating, pp. 628-638, Jun. 1959.

Patent Abstract of Japan, "Partial Plating Device," Publciation No. 01234590, Publication Date: Sep. 19, 1989.

Patent Abstract of Japan, "Plating Method" Publication No. 57171690, Publication Date: Oct. 22, 1982.

Singer, P., "Copper Goes Mainstream: Low k to Follow," Semiconductor International, pp. 67-70, Nov. 1997.

Lee, Tien-Yu Tom, et al., "Application of a CFD Tool in Designing a Fountain Plating Cell for Uniform Bump Plating of Semiconductor Wafers," IEEE Transactions on Components, Packaging, and Manufacturing Technology (Feb. 1996, pp. 131-137, vol. 19, No. 1.

Ritter et al., "Two- and Three- Diminsional Numerical Modeling of Copper Electroplating for Advanced ULSI Metallization," E-MRS converence, Symposium M. Basic Models to Enhance Reliability, Strasbourg (FRANCE) 1999.

* cited by examiner

FLOW VELOCITY COMPONENTS NORMAL TO WAFER

WORKPIECE PROCESSOR HAVING PROCESSING CHAMBER WITH IMPROVED PROCESSING FLUID FLOW

CROSS-REFERENCE TO RELATED APPLICATIONS

The present application is a continuation of U.S. application Ser. No. 09/804,696, filed Mar. 12, 2001 now U.S. Pat. No. 6,569,297, which is a continuation of International Application No. PCT/US00/10210, filed Apr. 13, 2000 in the English language and published in the English language as International Publication No. WO00/61837, which in turn claims priority to the following three U.S. Provisional Applications: Ser. No. 60/128,055, entitled "WORKPIECE PROCESSOR HAVING IMPROVED PROCESSING CHAMBER," filed Apr. 13, 1999; U.S. Ser. No. 60/143,769, entitled "WORKPIECE PROCESSING HAVING IMPROVED PROCESSING CHAMBER," filed Jul. 12, 1999; U.S. Ser. No. 60/182,160 entitled "WORKPIECE PROCESSOR HAVING IMPROVED PROCESSING CHAMBER," filed Feb. 14, 2000.

STATEMENT REGARDING FEDERALLY SPONSORED RESEARCH OR DEVELOPMENT

Not Applicable

BACKGROUND OF THE INVENTION

The fabrication of microelectronic components from a microelectronic workpiece, such as a semiconductor wafer substrate, polymer substrate, etc., involves a substantial number of processes. For purposes of the present application, a microelectronic workpiece is defined to include a workpiece formed from a substrate upon which microelectronic circuits or components, data storage elements or layers, and/or micro-mechanical elements are formed.

There are a number of different processing operations performed on the workpiece to fabricate the microelectronic component(s). Such operations include, for example, material deposition, patterning, doping, chemical mechanical polishing, electropolishing, and heat treatment. Material deposition processing involves depositing thin layers of material to the surface of the workpiece. Patterning provides removal of selected portions of these added layers. Doping of the microelectronic workpiece is the process of adding impurities known as "dopants" to the selected portions of the microelectronic workpiece to alter the electrical characteristics of the substrate material. Heat treatment of the microelectronic workpiece involves heating and/or cooling the microelectronic workpiece to achieve specific process results. Chemical mechanical polishing involves the removal of material through a combined chemical/mechanical process while electropolishing involves the removal of material from a workpiece surface using electrochemical reactions.

Numerous processing devices, known as processing "tools", have been developed to implement the foregoing processing operations. These tools take on different configurations depending on the type of workpiece used in the fabrication process and the process or processes executed by the tool. One tool configuration, known as the Equinox(R) wet processing tool and available from Semitool, Inc., of Kalispell, Mont., includes one or more workpiece processing stations that utilize a workpiece holder and a process bowl or container for implementing wet processing operations. Such wet processing operations include electroplating, etching, cleaning, electroless deposition, electropolishing, etc.

In accordance with one configuration of the foregoing Equinox(R) tool, the workpiece holder and the processing container are disposed proximate one another and function to bring the microelectronic workpiece held by the workpiece holder into contact with a processing fluid disposed in the processing container thereby forming a processing chamber. Restricting the processing fluid to the appropriate portions of the workpiece, however, is often problematic. Additionally, ensuring proper mass transfer conditions between the processing fluid and the surface of the workpiece can be difficult. Absent such mass transfer control, the processing of the workpiece surface can often be non-uniform.

Conventional workpiece processors have utilized various techniques to bring the processing fluid into contact with the surface of the workpiece in a controlled manner. For example, the processing fluid may be brought into contact with the surface of the workpiece using a controlled spray. In other types of processes, such as in partial or full immersion processing, the processing fluid resides in a bath and at least one surface of the workpiece is brought into contact with or below the surface of the processing fluid. Electroplating, electroless plating, etching, cleaning, anodization, etc. are examples of such partial or full immersion processing.

Existing processing containers often provide a continuous flow of processing solution to the processing chamber through one or more inlets disposed at the bottom portion of the chamber. Even distribution of the processing solution over the workpiece surface to control the thickness and uniformity of the diffusion layer conditions is facilitated, for example, by a diffuser or the like that is disposed between the one or more inlets and the workpiece surface. A general illustration of such a system is shown in FIG. 1A. The diffuser 1 includes a plurality of apertures 2 that are provided to disburse the stream of fluid provided from the processing fluid inlet 3 as evenly as possible across the surface of the workpiece 4.

Although substantial improvements in diffusion layer control result from the use of a diffuser, such control is limited. With reference to FIG. 1A, localized areas 5 of increased flow velocity normal to the surface of the microelectronic workpiece are often still present notwithstanding the diffuser 1. These localized areas generally correspond to the apertures 2 of the diffuser 1. This effect is increased as the diffuser 1 is placed closer to the microelectronic workpiece 4 since the distance over which the fluid is allowed to disburse as it travels from the diffuser to the workpiece is decreased. This reduced diffusion length results in a more concentrated stream of processing fluid at the localized areas 5.

The present inventors have found that these localized areas of increased flow velocity at the surface of the workpiece affect the diffusion layer conditions and can result in non-uniform processing of the surface of the workpiece. The diffusion layer tends to be thinner at the localized areas 5 when compared to other areas of the workpiece surface. The surface reactions occur at a higher rate in the localized areas in which the diffusion layer thickness is reduced thereby resulting in radially, non-uniform processing of the workpiece. Diffuser hole pattern configurations also affect the distribution of the electric field in electrochemical processes, such as electroplating, which can similarly result in non-uniform processing of the workpiece surface (e.g., non-uniform deposition of the electroplated material).

Another problem often encountered in immersion processing of the workpiece is disruption of the diffusion layer due to the entrapment of bubbles at the surface of the workpiece. Bubbles can be created in the plumbing and pumping system of the processing equipment and enter the processing chamber where they migrate to sites on the surface of the workpiece under process. Processing is inhibited at those sites due, for example, to the disruption of the diffusion layer.

As microelectronic circuit and device manufacturers decrease the size of the components and circuits that they manufacture, the need for tighter control over the diffusion layer conditions between the processing solution and the workpiece surface becomes more critical. To this end, the present inventors have developed an improved processing chamber that addresses the diffusion layer non-uniformities and disturbances that exist in the workpiece processing tools currently employed in the microelectronic fabrication industry. Although the improved processing chamber set forth below is discussed in connection with a specific embodiment that is adapted for electroplating, it will be recognized that the improved chamber may be used in any workpiece processing tool in which process uniformity across the surface of a workpiece is desired.

SUMMARY OF THE INVENTION

A processing container for providing a flow of a processing fluid during immersion processing of at least one surface of a microelectronic workpiece is set forth. The processing container comprises a principal fluid flow chamber providing a flow of processing fluid to at least one surface of the workpiece and a plurality of nozzles disposed to provide a flow of processing fluid to the principal fluid flow chamber. The plurality of nozzles are arranged and directed to provide vertical and radial fluid flow components that combine to generate a substantially uniform normal flow component radially across the surface of the workpiece. An exemplary apparatus using such a processing container is also set forth that is particularly adapted to carry out an electrochemical process, such as an electroplating process.

In accordance with a still further aspect of the present disclosure, a reactor for immersion processing of a microelectronic workpiece is set forth that includes a processing container having a processing fluid inlet through which a processing fluid flows into the processing container. The processing container also has an upper rim forming a weir over which processing fluid flows to exit from processing container. At least one helical flow chamber is disposed exterior to the processing container to receive processing fluid exiting from the processing container over the weir. Such a configuration assists in removing spent processing fluid from the site of the reactor while concurrently reducing turbulence during the removal process that might otherwise entrain air in the fluid stream or otherwise generate an unwanted degree of contact between the air and the processing fluid.

DETAILED DESCRIPTION OF THE INVENTIONS

Basic Reactor Components

Figure 1A:
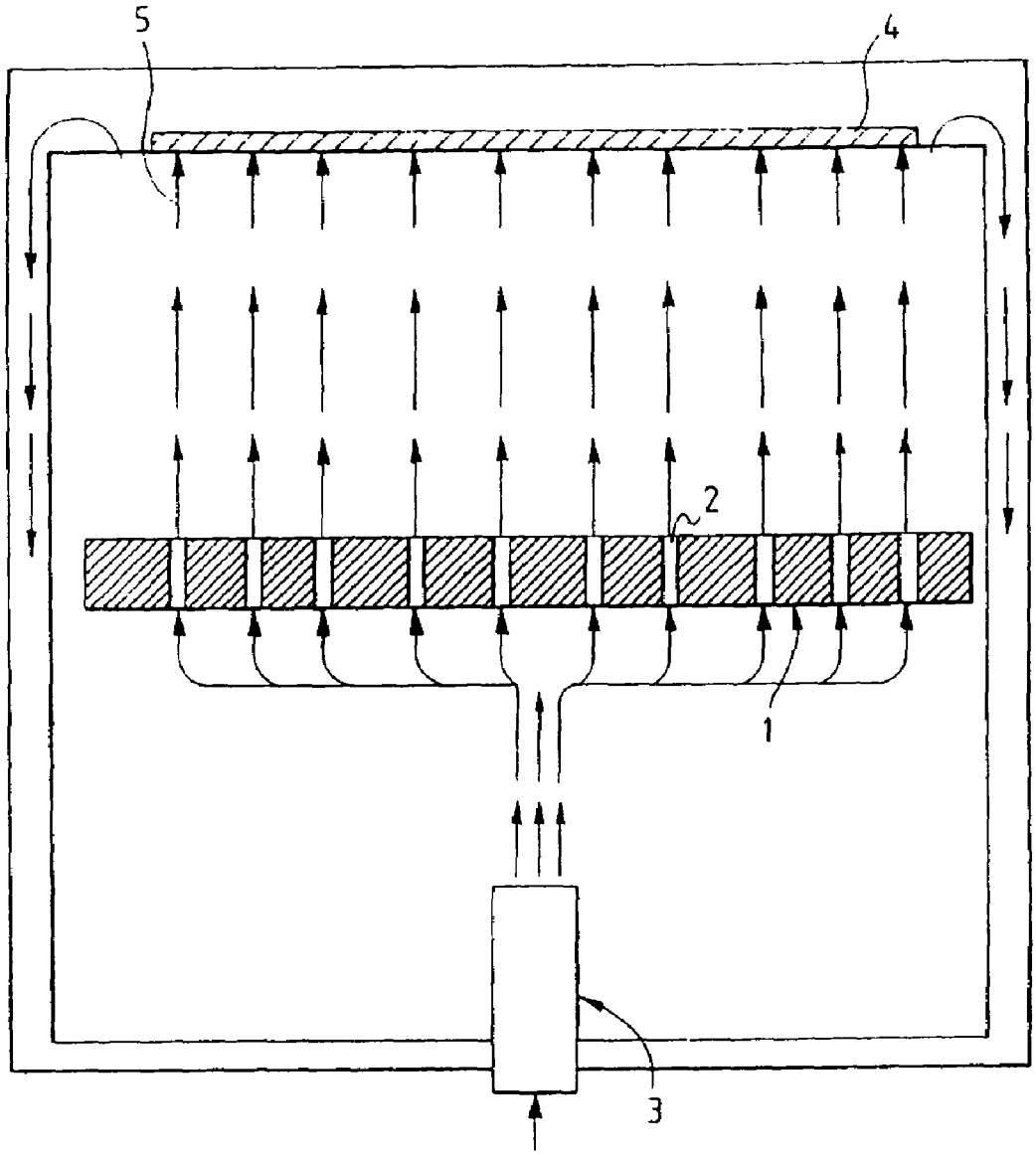
FIG. 1A PRIOR ART
FIG. 1A is schematic block diagram of an immersion processing reactor assembly that incorporates a diffuser to distribute a flow of processing fluid across a surface of a workpiece.
Figure 1B:
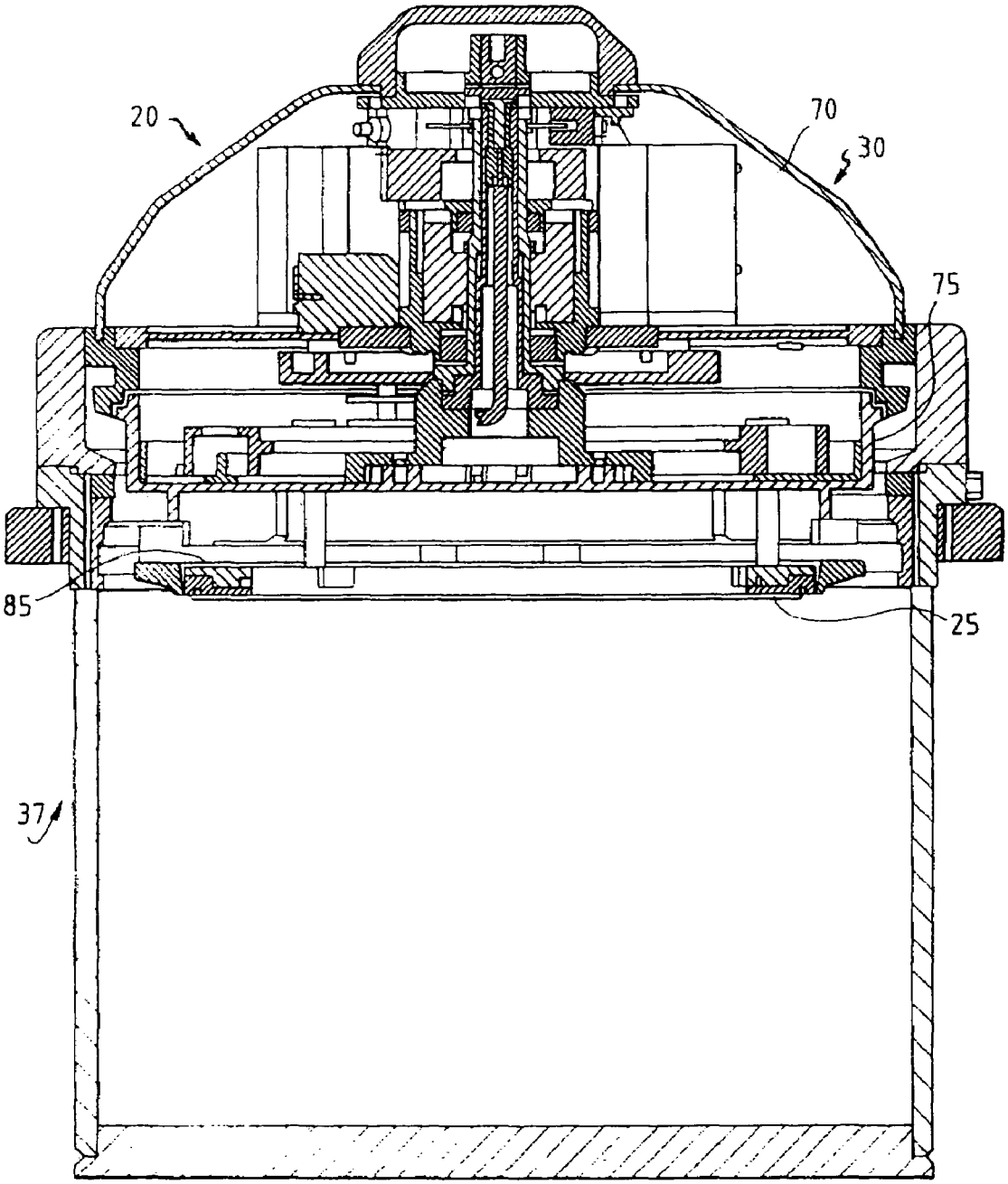
FIG. 1B is a cross-sectional view of one embodiment of a reactor assembly that may incorporate the present invention.

With reference to FIG. 1B, there is shown a reactor assembly 20 for immersion-processing a microelectronic workpiece 25, such as a semiconductor wafer. Generally stated, the reactor assembly 20 is comprised of a reactor head 30 and a corresponding processing base, shown generally at 37 and described in substantial detail below, in which the processing fluid is disposed. The reactor assembly of the specifically illustrated embodiment is particularly adapted for effecting electrochemical processing of semiconductor wafers or like workpieces. It will be recognized, however, that the general reactor configuration of FIG. 1B is suitable for other workpiece types and processes as well.

The reactor head 30 of the reactor assembly 20 may be comprised of a stationary assembly 70 and a rotor assembly 75. Rotor assembly 75 is configured to receive and carry an associated microelectronic workpiece 25, position the workpiece in a process-side down orientation within a processing container in processing base 37, and to rotate or spin the workpiece. Because the specific embodiment illustrated here is adapted for electroplating, the rotor assembly 75 also includes a cathode contact assembly 85 that provides electroplating power to the surface of the microelectronic workpiece. It will be recognized, however, that backside contact and/or support of the workpiece on the reactor head 30 may be implemented in lieu of front side contact/support illustrated here.

The reactor head 30 is typically mounted on a lift/rotate apparatus which is configured to rotate the reactor head 30 from an upwardly-facing disposition in which it receives the microelectronic workpiece to be plated, to a downwardly facing disposition in which the surface of the microelectronic workpiece to be plated is positioned so that it may be brought into contact with the processing fluid that is held within a processing container of the processing base 37. A robotic arm, which preferably includes an end effector, is typically employed for placing the microelectronic workpiece 25 in position on the rotor assembly 75, and for removing the plated microelectronic workpiece from within the rotor assembly. During loading of the microelectronic workpiece, assembly 85 may be operated between an open state that allows the microelectronic workpiece to be placed on the rotor assembly 75, and a closed state that secures the microelectronic workpiece to the rotor assembly for subsequent processing. In the context of an electroplating reactor, such operation also brings the electrically conductive components of the contact assembly 85 into electrical engagement with the surface of the microelectronic workpiece that is to be plated.

It will be recognized that other reactor assembly configurations may be used with the inventive aspects of the disclosed reactor chamber, the foregoing being merely illustrative.

Processing Container

Figure 2:
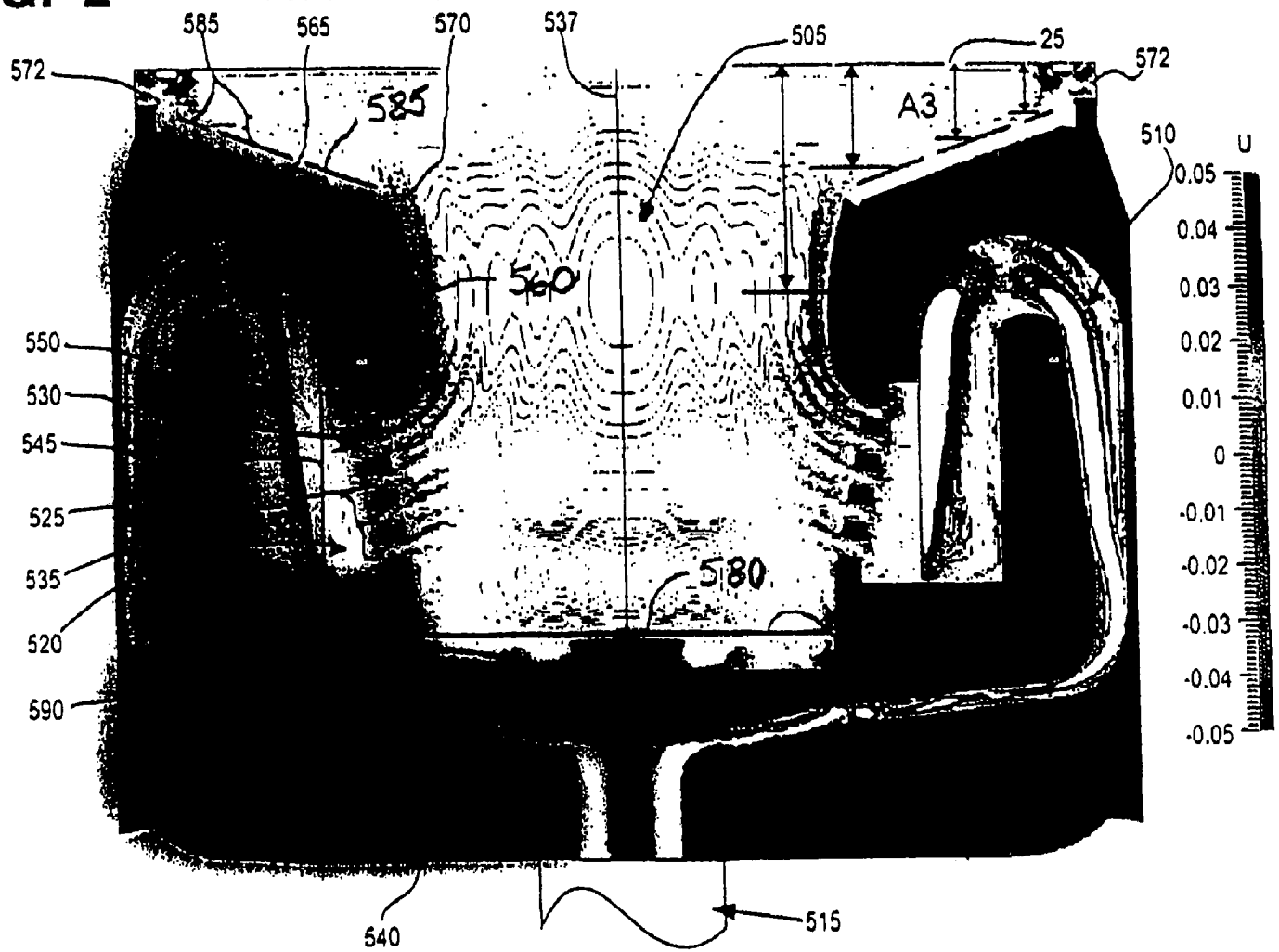
FIG. 2 is a schematic diagram of one embodiment of a reactor chamber that may be used in the reactor assembly of FIG. 1B and includes an illustration of the velocity flow profiles associated with the flow of processing fluid through the reactor chamber.

FIG. 2 illustrates the basic construction of processing base 37 and the corresponding flow velocity contour pattern resulting from the processing container construction. As illustrated, the processing base 37 generally comprises a main fluid flow chamber 505, an antechamber 510, a fluid inlet 515, a plenum 520, a flow diffuser 525 separating the plenum 520 from the antechamber 510, and a nozzle/slot assembly 530 separating the plenum 520 from the main fluid flow chamber 505. These components cooperate to provide a flow (here, of the electroplating solution) at the microelectronic workpiece 25 with a substantially radially independent normal component. In the illustrated embodiment, the impinging flow is centered about central axis 537 and possesses a nearly uniform component normal to the surface of the microelectronic workpiece 25. This results in a substantially uniform mass flux to the microelectronic workpiece surface that, in turn, enables substantially uniform processing thereof.

Processing fluid is provided through fluid inlet 515 disposed at the bottom of the container 35. The fluid from the fluid inlet 515 is directed therefrom at a relatively high velocity through antechamber 510. In the illustrated embodiment, antechamber 510 includes an acceleration channel 540 through which the processing fluid flows radially from the fluid inlet 515 toward fluid flow region 545 of antechamber 510. Fluid flow region 545 has a generally inverted U-shaped cross-section that is substantially wider at its outlet region proximate flow diffuser 525 than at its inlet region proximate acceleration channel 540. This variation in the cross-section assists in removing any gas bubbles from the processing fluid before the processing fluid is allowed to enter the main fluid flow chamber 505. Gas bubbles that would otherwise enter the main fluid flow chamber 505 are allowed to exit the processing base 37 through a gas outlet (not illustrated in FIG. 2, but illustrated in the embodiment shown in FIGS. 3-5) disposed at an upper portion of the antechamber 510.

Processing fluid within antechamber 510 is ultimately supplied to main fluid flow chamber 505. To this end, the processing fluid is first directed to flow from a relatively high-pressure region 550 of the antechamber 510 to the comparatively lower-pressure plenum 520 through flow diffuser 525. Nozzle assembly 530 includes a plurality of nozzles or slots 535 that are disposed at a slight angle with respect to horizontal. Processing fluid exits plenum 520 through nozzles 535 with fluid velocity components in the vertical and radial directions.

Main fluid flow chamber 505 is defined at its upper region by a contoured sidewall 560 and a slanted sidewall 565. The contoured sidewall 560 assists in preventing fluid flow separation as the processing fluid exits nozzles 535 (particularly the uppermost nozzle(s)) and turns upward toward the surface of microelectronic workpiece 25. Beyond breakpoint 570, fluid flow separation will not substantially affect the uniformity of the normal flow. As such, slanted sidewall 565 can generally have any shape, including a continuation of the shape of contoured sidewall 560. In the specific embodiment disclosed here, sidewall 565 is slanted and, in those applications involving electrochemical processing is used to support one or more anodes/electrical conductors.

Processing fluid exits from main fluid flow chamber 505 through a generally annular outlet 572. Fluid exiting annular outlet 572 may be provided to a further exterior chamber for disposal or may be replenished for re-circulation through the processing fluid supply system.

In those instances in which the processing base 37 forms part of an electroplating reactor, the processing base 37 is provided with one or more anodes. In the illustrated embodiment, a central anode 580 is disposed in the lower portion of the main fluid flow chamber 505. If the peripheral edges of the surface of the microelectronic workpiece 25 extend radially beyond the extent of contoured sidewall 560, then the peripheral edges are electrically shielded from central anode 580 and reduced plating will take place in those regions. However, if plating is desired in the peripheral regions, one or more further anodes may be employed proximate the peripheral regions. Here, a plurality of annular anodes 585 are disposed in a generally concentric manner on slanted sidewall 565 to provide a flow of electroplating current to the peripheral regions. An alternative embodiment would include a single anode or multiple anodes with no shielding from the contoured walls to the edge of the microelectronic workpiece.

The anodes 580, 585 may be provided with electroplating power in a variety of manners. For example, the same or different levels of electroplating power may be multiplexed to the anodes 580, 585 Alternatively, all of the anodes 580, 585 may be connected to receive the same level of electroplating power from the same power source. Still further, each of the anodes 580, 585 may be connected to receive different levels of electroplating power to compensate for the variations in the resistance of the plated film. An advantage of the close proximity of the anodes 585 to the microelectronic workpiece 25 is that it provides a high degree of control of the radial film growth resulting from each anode.

Gases may undesirably be entrained in the processing fluid as the processing fluid circulates through the processing system. These gases may form bubbles that ultimately find their way to the diffusion layer and thereby impair the uniformity of the processing that takes place at the surface of the workpiece. To reduce this problem, as well as to reduce the likelihood of the entry of bubbles into the main fluid flow chamber 505, processing base 37 includes several unique features. With respect to central anode 580, a Venturi flow path 590 is provided between the underside of central anode 580 and the relatively lower pressure region of acceleration channel 540. In addition to desirably influencing the flow effects along central axis 537, this path results in a Venturi effect that causes the processing fluid proximate the surfaces disposed at the lower portion of the chamber, such as at the surface of central anode 580, to be drawn into acceleration channel 540 and may assist in sweeping gas bubbles away from the surface of the anode. More significantly, this Venturi effect provides a suction flow that affects the uniformity of the impinging flow at the central portion of the surface of the microelectronic workpiece along central axis 537. Similarly, processing fluid sweeps across the surfaces at the upper portion of the chamber, such as the surfaces of anodes 585, in a radial direction toward annular outlet 572 to remove gas bubbles present at such surfaces. Further, the radial components of the fluid flow at the surface of the microelectronic workpiece assists in sweeping gas bubbles therefrom.

There are numerous processing advantages with respect to the illustrated flow through the reactor chamber. As illustrated, the flow through the nozzles/slots 535 is directed away from the microelectronic workpiece surface and, as such, there are no substantial localized normal of flow components of fluid created that disturb the substantial uniformity of the diffusion layer. Although the diffusion layer may not be perfectly uniform, any non-uniformity will be relatively gradual as a result. Further, in those instances in which the microelectronic workpiece is rotated, such remaining non-uniformities in the diffusion layer can often be tolerated while consistently achieving processing goals.

As is also evident from the foregoing reactor design, the flow that is normal to the microelectronic workpiece has a slightly greater magnitude near the center of the microelectronic workpiece. This creates a dome-shaped meniscus whenever the microelectronic workpiece is not present (i.e., before the microelectronic workpiece is lowered into the fluid). The dome-shaped meniscus assists in minimizing bubble entrapment as the microelectronic workpiece is lowered into the processing solution.

The flow at the bottom of the main fluid flow chamber 505 resulting from the Venturi flow path influences the fluid flow at the centerline thereof. The centerline flow velocity is otherwise difficult to implement and control. However, the strength of the Venturi flow provides a non-intrusive design variable that may be used to affect this aspect of the flow.

A still further advantage of the foregoing reactor design is that it assists in preventing bubbles that find their way to the chamber inlet from reaching the microelectronic workpiece. To this end, the flow pattern is such that the solution travels downward just before entering the main chamber. As such, bubbles remain in the antechamber and escape through holes at the top thereof. Further, bubbles are-prevented from entering the main chamber through the Venturi flow path through the use of the shield that covers the Venturi flow path (see description of the embodiment of the reactor illustrated in FIGS. 3-5). Still further, the upward sloping inlet path (see FIG. 5 and appertaining description) to the antechamber prevents bubbles from entering the main chamber through the Venturi flow path.

Figure 3A:
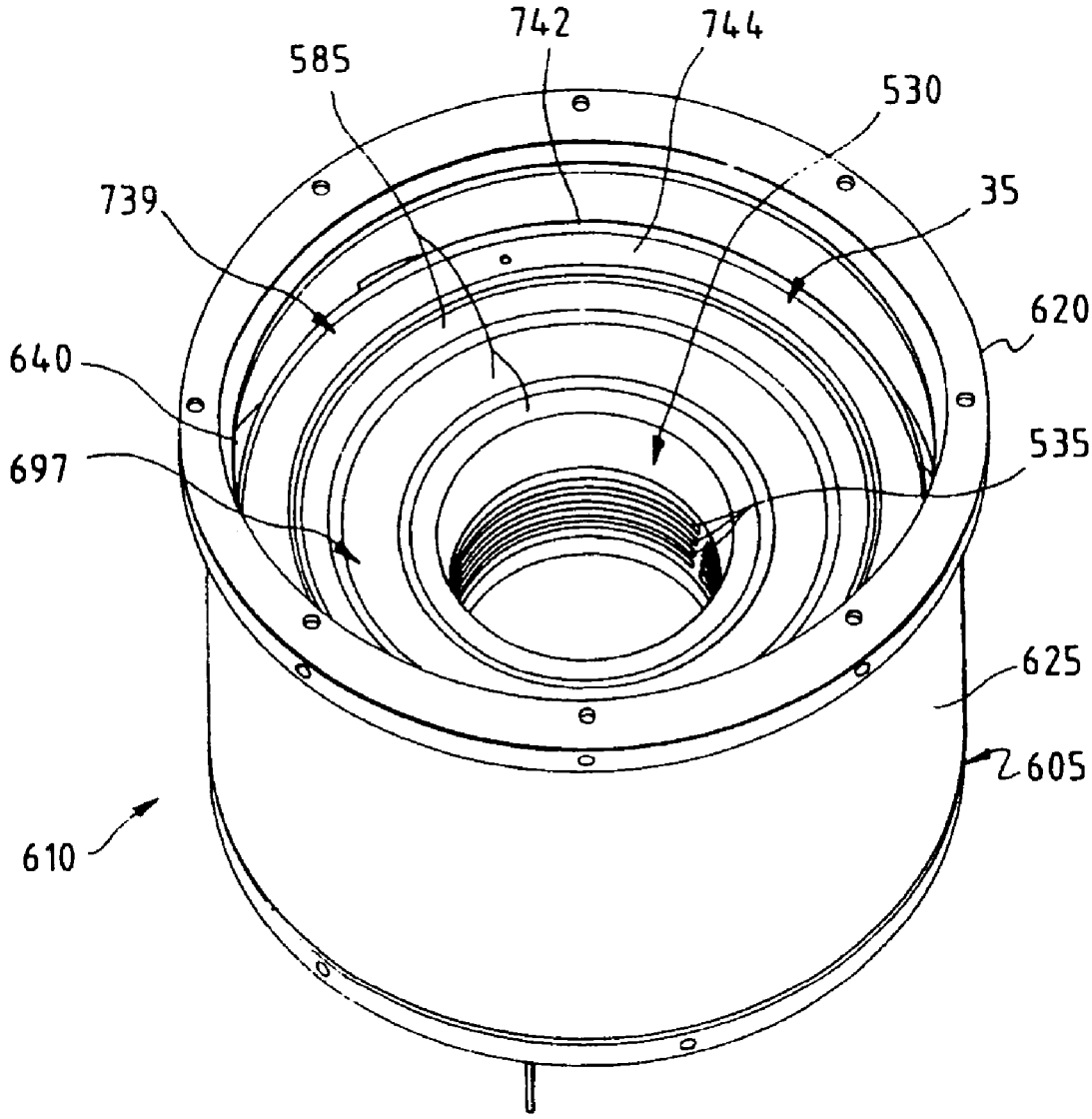
FIGS. 3A-5 illustrate a specific construction of a complete processing chamber assembly that has been specifically adapted for electrochemical processing of a semiconductor wafer and that has been implemented to achieve the velocity flow profiles set forth in FIG. 2.
Figure 3B:
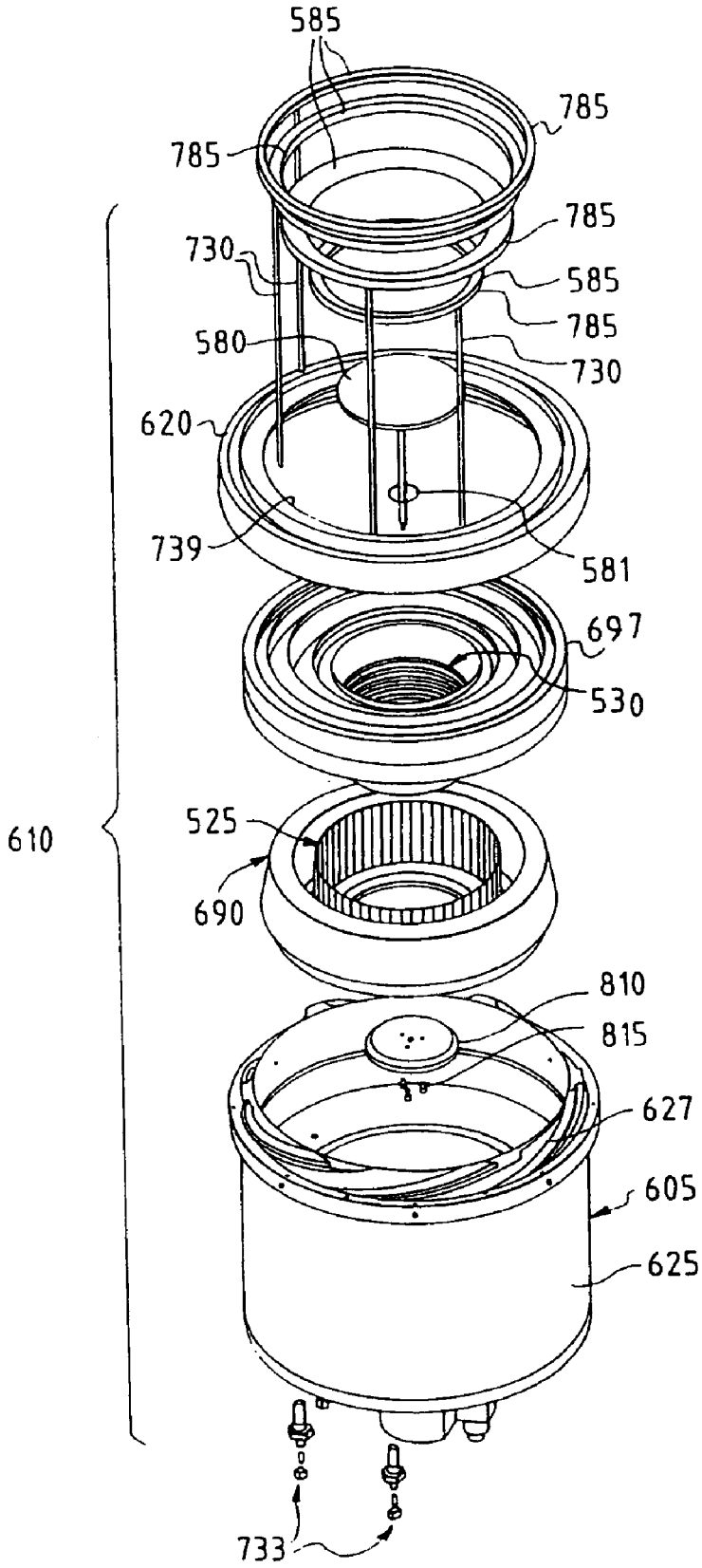
Figure 4:
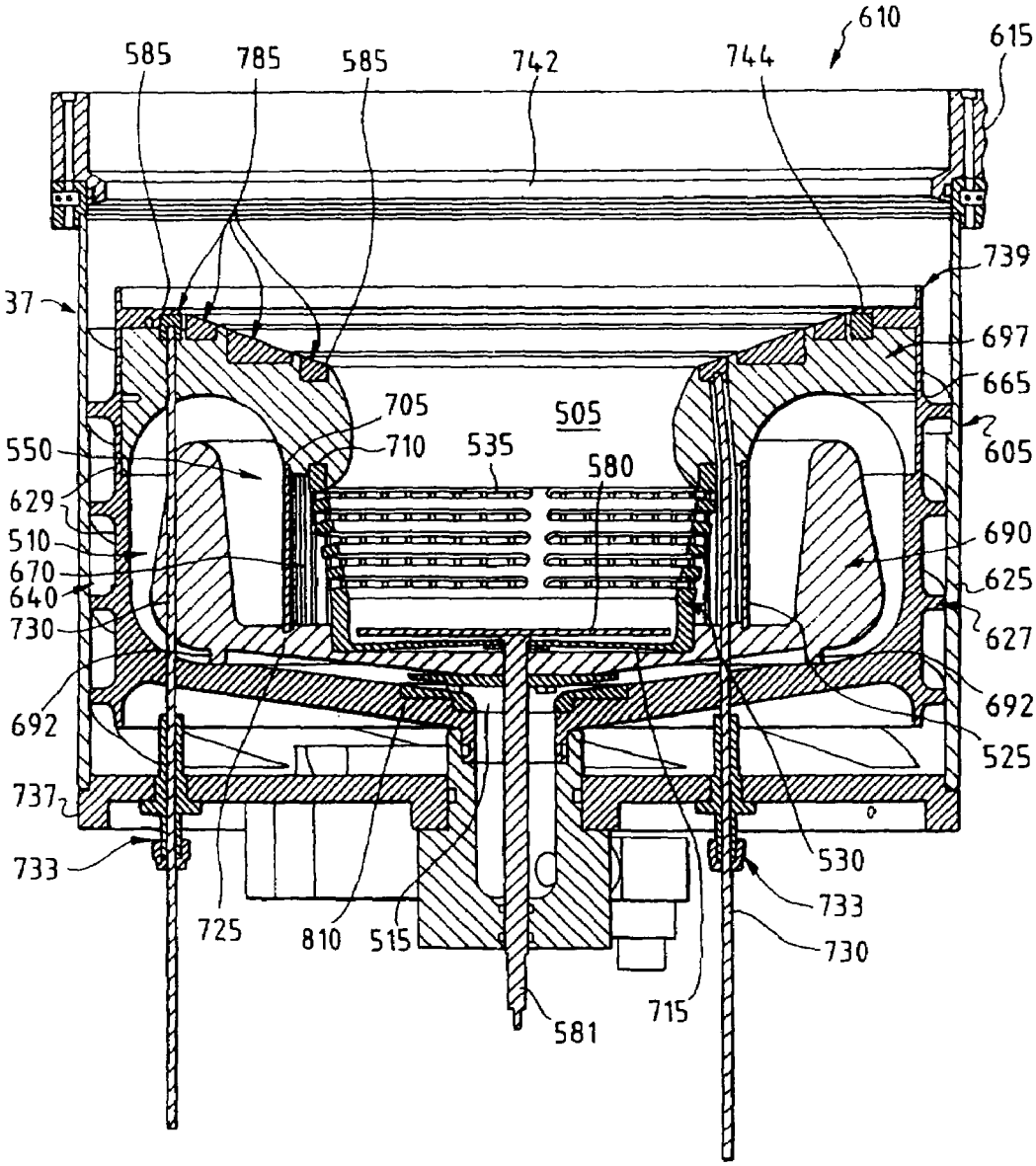
Figure 5:
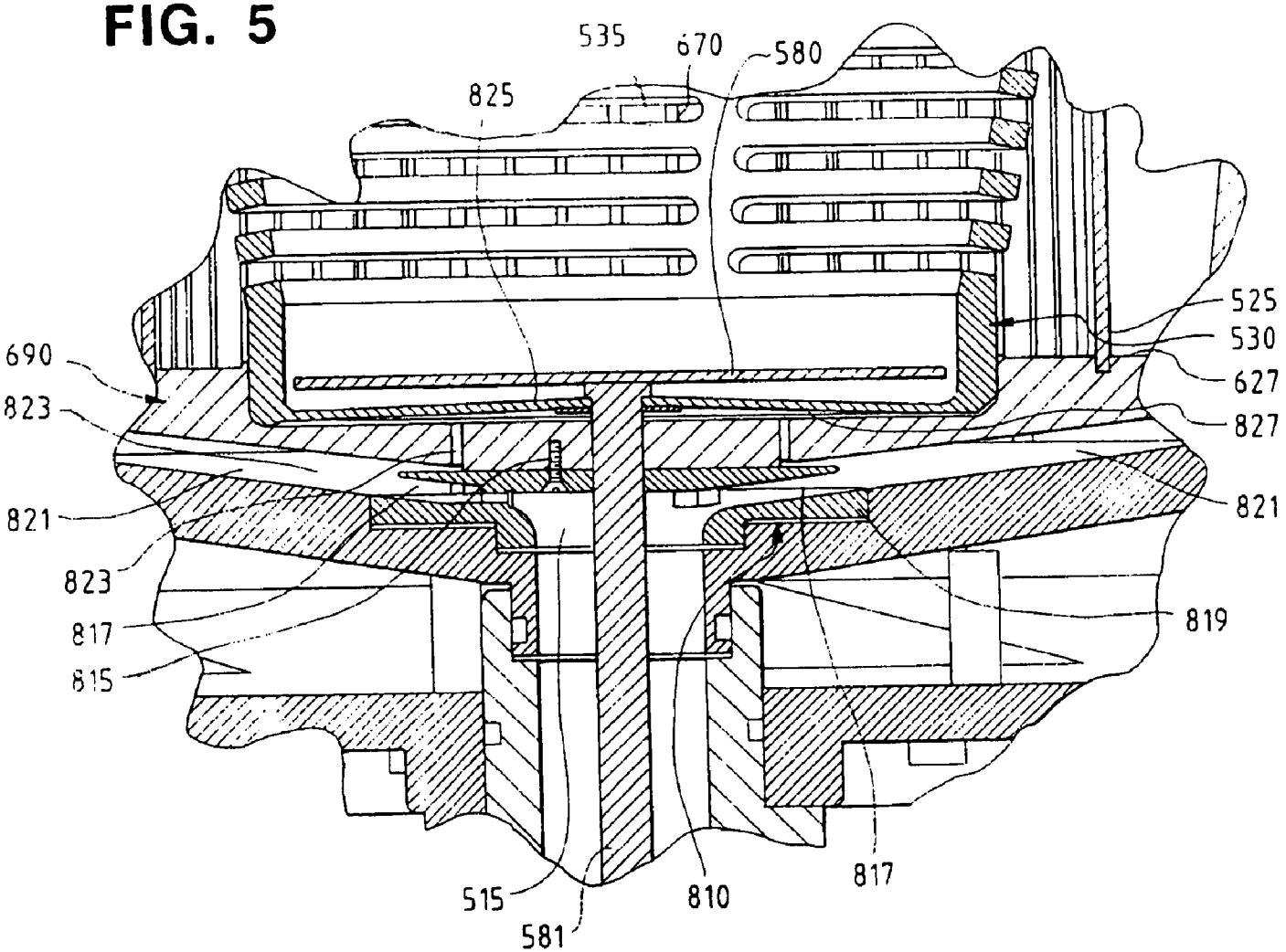

FIGS. 3-5 illustrate a specific construction of a complete processing chamber assembly 610 that has been specifically adapted for electrochemical processing of a semiconductor microelectronic workpiece. More particularly, the illustrated embodiment is specifically adapted for depositing a uniform layer of material on the surface of the workpiece using electroplating.

As illustrated, the processing base 37 shown in FIG. 1B is comprised of processing chamber assembly 610 along with a corresponding exterior cup 605. Processing chamber assembly 610 is disposed within exterior cup 605 to allow exterior cup 605 to receive spent processing fluid that overflows from the processing chamber assembly 610. A flange 615 extends about the assembly 610 for securement with, for example, the frame of the corresponding tool.

With particular reference to FIGS. 4 and 5, the flange of the exterior cup 605 is formed to engage or otherwise accept rotor assembly 75 of reactor head 30 (shown in FIG. 1B) and allow contact between the microelectronic workpiece 25 and the processing solution, such as electroplating solution, in the main fluid flow chamber 505. The exterior cup 605 also includes a main cylindrical housing 625 into which a drain cup member 627 is disposed. The drain cup member 627 includes an outer surface having channels 629 that, together with the interior wall of main cylindrical housing 625, form one or more helical flow chambers 640 that serve as an outlet for the processing solution. Processing fluid overflowing a weir member 739 at the top of processing cup 35 drains through the helical flow chambers 640 and exits an outlet (not illustrated) where it is either disposed of or replenished and re-circulated. This configuration is particularly suitable for systems that include fluid re-circulation since it assists in reducing the mixing of gases with the processing solution thereby further reducing the likelihood that gas bubbles will interfere with the uniformity of the diffusion layer at the workpiece surface.

In the illustrated embodiment, antechamber 510 is defined by the walls of a plurality of separate components. More particularly, antechamber 510 is defined by the interior walls of drain cup member 627, an anode support member 697, the interior and exterior walls of a mid-chamber member 690, and the exterior walls of flow diffuser 525.

FIGS. 3B and 4 illustrate the manner in which the foregoing components are brought together to form the reactor. To this end, the mid-chamber member 690 is disposed interior of the drain cup member 627 and includes a plurality of leg supports 692 that sit upon a bottom wall thereof. The anode support member 697 includes an outer wall that engages a flange that is disposed about the interior of drain cup member 627. The anode support member 697 also includes a channel 705 that sits upon and engages an upper portion of flow diffuser 525, and a further channel 710 that sits upon and engages an upper rim of nozzle assembly 530. Mid-chamber member 690 also includes a centrally disposed receptacle 715 that is dimensioned to accept the lower portion of nozzle assembly 530. Likewise, an annular channel 725 is disposed radially exterior of the annular receptacle 715 to engage a lower portion of flow diffuser 525.

In the illustrated embodiment, the flow diffuser 525 is formed as a single piece and includes a plurality of vertically oriented slots 670. Similarly, the nozzle assembly 530 is formed as a single piece and includes a plurality of horizontally oriented slots that constitute the nozzles 535.

The anode support member 697 includes a plurality of annular grooves that are dimensioned to accept corresponding annular anode assemblies 785. Each anode assembly 785 includes an anode 585 (preferably formed from platinized titanium or in other inert metal) and a conduit 730 extending from a central portion of the anode 585 through which a metal conductor may be disposed to electrically connect the anode 585 of each assembly 785 to an external source of electrical power. Conduit 730 is shown to extend entirely through the processing chamber assembly 610 and is secured at the bottom thereof by a respective fitting 733. In this manner, anode assemblies 785 effectively urge the anode support member 697 downward to clamp the flow diffuser 525, nozzle assembly 530, mid-chamber member 690, and drain cup member 627 against the bottom portion 737 of the exterior cup 605. This allows for easy assembly and disassembly of the processing chamber 610. However, it will be recognized that other means may be used to secure the chamber elements together as well as to conduct the necessary electrical power to the anodes.

The illustrated embodiment also includes a weir member 739 that detachably snaps or otherwise easily secures to the upper exterior portion of anode support member 697. As shown, weir member 739 includes a rim 742 that forms a weir over which the processing solution flows into the helical flow chamber 640. Weir member 739 also includes a transversely extending flange 744 that extends radially inward and forms an electric field shield over all or portions of one or more of the anodes 585. Since the weir member 739 may be easily removed and replaced, the processing chamber assembly 610 may be readily reconfigured and adapted to provide different electric field shapes. Such differing electrical field shapes are particularly useful in those instances in which the reactor must be configured to process more than one size or shape of a workpiece. Additionally, this allows the reactor to be configured to accommodate workpieces that are of the same size, but have different plating area requirements.

The anode support member 697, with the anodes 585 in place, forms the contoured sidewall 560 and slanted sidewall 565 that is illustrated in FIG. 2. As noted above, the lower region of anode support member 697 is contoured to define the upper interior wall of antechamber 510 and preferably includes one or more gas outlets 665 that are disposed therethrough to allow gas bubbles to exit from the antechamber 510 to the exterior environment.

With particular reference to FIG. 5, fluid inlet 515 is defined by an inlet fluid guide, shown generally at 810, that is secured to mid-chamber member 690 by one or more fasteners 815. Inlet fluid guide 810 includes a plurality of open channels 817 that guide fluid received at fluid inlet 515 to an area beneath mid-chamber member 690. Channels 817 of the illustrated embodiment are defined by upwardly angled walls 819. Processing fluid exiting channels 817 flows therefrom to one or more further channels 821 that are likewise defined by walls that angle upward.

Central anode 580 includes an electrical connection rod 581 that proceeds to the exterior of the processing chamber assembly 610 through central apertures formed in nozzle assembly 530, mid-chamber member 690 and inlet fluid guide 810. The Venturi flow path regions shown at 590 in FIG. 2 are formed in FIG. 5 by vertical channels 823 that proceed through drain cup member 627 and the bottom wall of nozzle member 530. As illustrated, the fluid inlet guide 810 and, specifically, the upwardly angled walls 819 extend radially beyond the shielded vertical channels 823 so that any bubbles entering the inlet proceed through the upward channels 821 rather than through the vertical channels 823.

Figure 6:
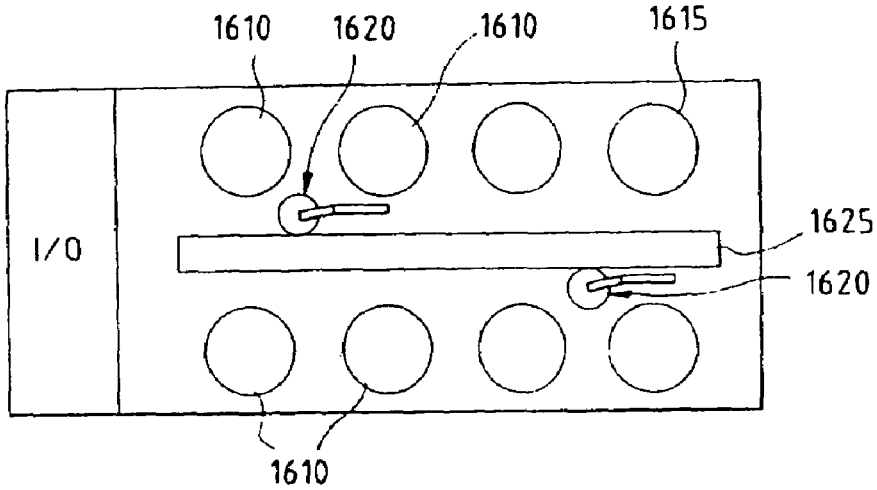
FIGS. 6 and 7 illustrate two embodiments of processing tools that may incorporate one or more processing stations constructed in accordance with the teachings of the present invention.
Figure 7:
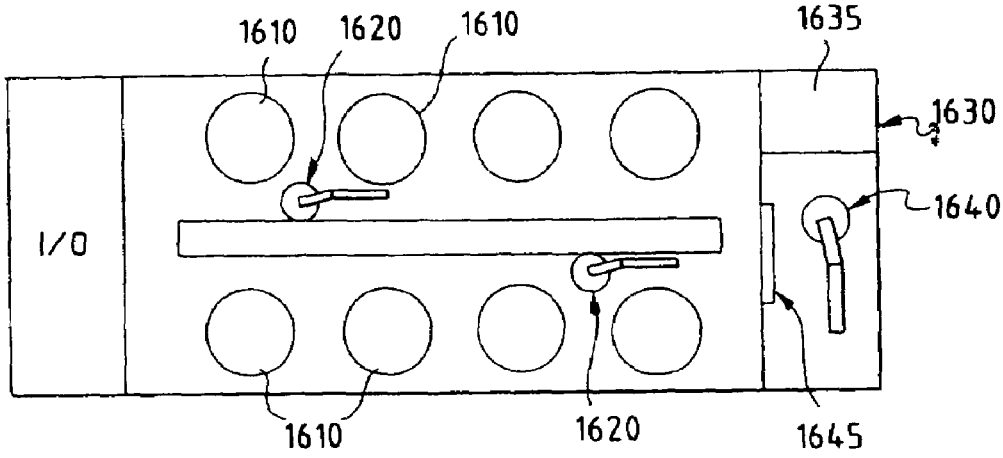

The foregoing reactor assembly may be readily integrated in a processing tool that is capable of executing a plurality of processes on a workpiece, such as a semiconductor microelectronic workpiece. One such processing tool is the LT-210™ electroplating apparatus available from Semitool, Inc., of Kalispell, Mont. FIGS. 6 and 7 illustrate such integration. The system of FIG. 6 includes a plurality of processing stations 1610. Preferably, these processing stations include one or more rinsing/drying stations and one or more electroplating stations (including one or more electroplating reactors such as the one above), although further immersion-chemical processing stations constructed in accordance with the of the present invention may also be employed. The system also preferably includes a thermal processing station, such as at 1615, that includes at least one thermal reactor that is adapted for rapid thermal processing (RTP).

The workpieces are transferred between the processing stations 1610 and the RTP station 1615 using one or more robotic transfer mechanisms 1620 that are disposed for linear movement along a central track 1625. One or more of the stations 1610 may also incorporate structures that are adapted for executing an in-situ rinse. Preferably, all of the processing stations as well as the robotic transfer mechanisms are disposed in a cabinet that is provided with filtered air at a positive pressure to thereby limit airborne contaminants that may reduce the effectiveness of the microelectronic workpiece processing.

FIG. 7 illustrates a further embodiment of a processing tool in which an RTP station 1635, located in portion 1630, that includes at least one thermal reactor, may be integrated in a tool set. Unlike the embodiment of FIG. 6, in this embodiment, at least one thermal reactor is serviced by a dedicated robotic mechanism 1640. The dedicated robotic mechanism 1640 accepts workpieces that are transferred to it by the robotic transfer mechanisms 1620. Transfer may take place through an intermediate staging door/area 1645. As such, it becomes possible to hygienically separate the RTP portion 1630 of the processing Tool from other portions of the tool. Additionally, using such a construction, the illustrated annealing station may be implemented as a separate module that is attached to upgrade an existing tool set. It will be recognized that other types of processing stations may be located in portion 1630 in addition to or instead of RTP station 1635.

Numerous modifications may be made to the foregoing system without departing from the basic teachings thereof. Although the present invention has been described in substantial detail with reference to one or more specific embodiments, those of skill in the art will recognize that changes may be made thereto without departing from the scope and spirit of the invention as set forth herein.

We claim:

1. A reactor for electrochemically processing least one surface of a microelectronic workpiece, the processing container comprising:

a reactor head having a workpiece holder configured to hold a microelectronic wafer process-side downward and a plurality of electrical contacts configured to provide electroplating power to the process-side of the microelectronic wafer; and a container having (a) principal fluid flow chamber having a processing zone configured to process a workpiece in a horizontal position, (b) a weir in the fluid flow chamber over which the processing solution can flow, and (c) a plurality of nozzles angularly disposed in one or more sidewalls of the principal fluid flow chamber at a level within the principal fluid flow chamber below the weir.

2. A microelectronic workpiece processing container as claimed in claim 1 wherein the plurality of nozzles are disposed in the one or more sidewalls of the principal fluid flow chamber so as to form a substantially uniform normal flow component radially across the surface of the workpiece in which the substantially uniform normal flow component is slightly greater at a radial central portion thereby forming a meniscus that assists in preventing air entrapment as the workpiece is brought into engagement with the surface of the processing fluid in the processing container.

3. A microelectronic workpiece processing container as claimed in claim 1 and further comprising an antechamber upstream of the plurality of nozzles, the antechamber being dimensioned to assist in the removal of gaseous components entrained in the processing fluid.

4. A microelectronic workpiece processing container as claimed in claim 3 and further comprising a plenum disposed between the antechamber and the plurality of nozzles.

5. A microelectronic workpiece processing container as claimed in claim 4 wherein the antechamber comprises an inlet and an outlet, the inlet having a smaller cross-section compared to the outlet.

6. A microelectronic workpiece processing container as claimed in claim 1 wherein at least some of the plurality of nozzles are generally horizontal slots disposed through the one or more sidewalls of the principal fluid flow chamber.

7. A processing container as claimed in claim 1 wherein the principal fluid flow chamber comprises one or more contoured sidewalls at an upper portion thereof to inhibit fluid flow separation as the processing fluid flows toward an upper portion of the principal fluid flow chamber to contact the surface of the microelectronic workpiece.

8. A processing container as claimed in claim 1 wherein the principal fluid flow chamber is defined at an upper portion thereof by an angled wall.

9. A microelectronic workpiece processing container as claimed in claim 1 wherein the principal fluid flow chamber further comprises a Venturi effect inlet disposed at a lower portion thereof.

10. A microelectronic workpiece processing container as claimed in claim 9 wherein the Venturi effect inlet is configured to provide a Venturi effect that facilitates recirculation of processing fluid flow in a lower portion of the principal fluid flow chamber.

11. A reactor for immersion processing at least one surface of a microelectronic workpiece, the reactor comprising:

a reactor head including a workpiece support configured to hold a workpiece at least substantially horizontally in a processing position and a motor connected to the workpiece support, wherein the motor is configured to rotate the workpiece support about a vertically orientated axis;

one or more electrical contacts disposed on the workpiece support and positioned thereon to make electrical contact with the microelectronic workpiece;

a processing container including a principal fluid flow chamber having a weir over which a processing solution can flow and a plurality of nozzles angularly disposed in a sidewall of the principal fluid flow chamber at a level within the principal fluid flow chamber below the weir; and a plurality of individually operable electrical conductors in the principal fluid flow chamber.

12. A reactor as claimed in claim 11 and further comprising an electrode disposed at a lower portion of the processing container to provide electrical contact between an electrical power supply and the processing fluid.

13. A reactor as claimed in claim 12 wherein the processing container is defined at an upper portion thereof by an angled wall, the processing container further comprising at least one further electrode in fixed positional alignment with the angled wall to provide electrical contact between an electrical power supply and the processing fluid.

14. An apparatus for processing a microelectronic workpiece comprising:

a plurality of workpiece processing stations;

a microelectronic workpiece robotic transfer;

at least one of the plurality of workpiece processing stations including a reactor having a processing container comprising a principal fluid flow chamber having a processing zone configured to process a workpiece in a horizontal position;

a weir in the principal fluid flow chamber over which a processing solution can flow;

a plurality of nozzles angularly disposed in one or more sidewalls of the principal fluid flow chamber at a level within the principal fluid flow chamber below the weir; and a plurality of individually operable concentric anodes in the principal fluid flow chamber.

15. An apparatus as claimed in claim 14 wherein the plurality of nozzles are disposed with respect to one another to provide vertical and radial fluid flow components that combine to generate a substantially uniform normal flow component radially across the at least one surface of the workpiece.

16. An apparatus as claimed in claim 14 wherein the plurality of nozzles are arranged so that the substantially uniform normal flow component is slightly greater at a radial central portion as referenced to the workpiece thereby forming a meniscus that assists in preventing air entrapment as the workpiece is brought into engagement with the surface of the processing fluid in the processing container.

17. An apparatus as claimed in claim 16 wherein at least some of the plurality of nozzles are generally horizontal slots in the one or more sidewalls of the principal fluid flow chamber.

18. An apparatus as claimed in claim 14 wherein the processing container further comprises a vented antechamber upstream of the plurality of nozzles.

19. An apparatus as claimed in claim 18 wherein the processing container further comprises a plenum disposed between the vented antechamber and the plurality of nozzles.

20. An apparatus as claimed in claim 18 wherein the vented antechamber comprises an inlet portion and an outlet portion, the inlet portion having a smaller cross-section compared to the outlet portion.

21. An apparatus as claimed in claim 14 wherein the principal fluid flow chamber further comprises a Venturi effect inlet.

22. An apparatus as claimed in claim 21 wherein the Venturi effect inlet generates a Venturi effect that facilitates recirculation of processing fluid flow in a lower portion of the principal fluid flow chamber.

23. A reactor for electrochemically processing at least one surface of a microelectronic workpiece, the processing container comprising:

a reactor head having a workpiece holder configured to hold a microelectronic wafer process-side downward and a plurality of electrical contacts configured to provide electroplating power to the process-side of the microelectronic wafer; and a container having:

(a) a principal fluid flow chamber having a processing zone configured to process a workpiece in a horizontal position, (b) a weir in the fluid flow chamber over which the processing solution can flow, (c) a plurality of nozzles angularly disposed in one or more sidewalls of the principal fluid flow chamber at a level within the principal fluid flow chamber below the weir, and (d) a plurality of individually operable concentric anodes in the principal fluid flow chamber.

24. A microelectronic workpiece processing container as claimed in claim 23 wherein the plurality of nozzles are disposed in the one or more sidewalls of the principal fluid flow chamber so as to form a substantially uniform normal flow component radially across the surface of the workpiece in which the substantially uniform normal flow component is slightly greater at a radial central portion thereby forming a meniscus that assists in preventing air entrapment as the workpiece is brought into engagement with the surface of the processing fluid in the processing container.

25. A microelectronic workpiece processing container as claimed in claim 23 and further comprising an antechamber upstream of the plurality of nozzles, the antechamber being dimensioned to assist in the removal of gaseous components entrained in the processing fluid.

26. A microelectronic workpiece processing container as claimed in claim 25 and further comprising a plenum disposed between the antechamber and the plurality of nozzles.

27. A microelectronic workpiece processing container as claimed in claim 23 wherein the antechamber comprises an inlet and an outlet, the inlet having a smaller cross-section compared to the outlet.

28. A microelectronic workpiece processing container as claimed in claim 23 wherein at least some of the plurality of nozzles are generally horizontal slots disposed through the one or more sidewalls of the principal fluid flow chamber.

29. A processing container as claimed in claim 23 wherein the principal fluid flow chamber comprises one or more contoured sidewalls at an upper portion thereof to inhibit fluid flow separation as the processing fluid flows toward an upper portion of the principal fluid flow chamber to contact the surface of the microelectronic workpiece.

30. A processing container as claimed in claim 23 wherein the principal fluid flow chamber is defined at an upper portion thereof by an angled wall.

31. A microelectronic workpiece processing container as claimed in claim 23 wherein the principal fluid flow chamber further comprises a Venturi effect inlet disposed at a lower portion thereof.

32. A microelectronic workpiece processing container as claimed in claim 31 wherein the Venturi effect inlet is configured to provide a Venturi effect that facilitates recirculation of processing fluid flow in a lower portion of the principal fluid flow chamber.

* * * * *